United States Patent [19]

Jones

[11] Patent Number: 4,466,148

[45] Date of Patent: Aug. 21, 1984

[54] HANDGUN HOLSTER MOUNTING DEVICE

[76] Inventor: Donald G. Jones, 1405 W. Sixth St., Ontario, Calif. 91762

[21] Appl. No.: 444,993

[22] Filed: Jan. 24, 1983

[51] Int. Cl.[3] ..... A47B 96/06; B65D 19/44

[52] U.S. Cl. ..... 5/503; 5/508; 248/200; 248/205.1; 108/55.1

[58] Field of Search ..... 248/205 R, 216.4, 220.2, 248/200, 205.1; 211/64; 108/28, 55.1; 297/252, 194; 224/42.38, 42.39, 42.45 R, 911; 5/503, 508, 498

[56] References Cited

U.S. PATENT DOCUMENTS

| | | |
|---|---|---|
| 1,702,553 | 2/1929 | Tribble . |
| 2,068,560 | 1/1937 | Morris . |
| 2,459,246 | 1/1949 | Sinclair . |
| 2,518,538 | 8/1950 | Giblin . |
| 2,557,674 | 6/1951 | McRae . |
| 2,675,926 | 4/1954 | Simjian . |
| 2,701,883 | 2/1955 | De Fazid . |
| 2,917,261 | 12/1959 | Stough . |
| 3,081,464 | 3/1963 | Lochner . |
| 3,482,810 | 12/1969 | Bailey . |
| 3,635,381 | 1/1972 | Hensley . |
| 4,199,831 | 4/1980 | Müller . |

*Primary Examiner*—Alexander Grosz
*Assistant Examiner*—Vinh Luong
*Attorney, Agent, or Firm*—Harold S. Gault

[57] ABSTRACT

A pair of brackets positioned on opposite sides or opposite ends of a mattress and interconnected by a strap or the like which is disposed between the mattress and box spring or other mattress support; at least one of the opposing brackets being fitted with a holster support bar which is vertically adjustable utilizing a plurality of apertures in the bracket and conventional means of attachment such as bolts and nuts or other fasteners. The holster support bar fits through the belt loop of a belt-type holster or within the clip of a clip-on holster which is held in position adjacent to the mattress.

3 Claims, 4 Drawing Figures

HANDGUN HOLSTER MOUNTING DEVICE

BACKGROUND OF THE INVENTION

This invention relates to a novel device for mounting a handgun holster in position adjacent to a mattress and box spring or other mattress support.

The occupant of a bed who requires a handgun within reach for personal security must be able to locate, reach, grasp, and secure a handgun in a minimum amount of time under adverse conditions, such as when the occupant of a bed is in total darkness having been suddenly awakened by an intruder. Under such circumstances, a handgun in a nearby dresser drawer or other closed container, or on a bedside table, or under the bed, or under the mattress or pillow, may not be positioned so as to be reliably located, reached, grasped, and secured in a minimum amount of time. This problem is addressed by the inventive device which provides for mounting two handgun holsters or a single handgun holster in a chosen position adjacent to a bed so that the holstered handgun is within easy grasp of the occupant of the bed. Thus, the inventive device takes advantage of the utility of the conventional handgun holster which is the accepted means for both holding a handgun in a fixed proximity and relationship to the user and safely storing a handgun in a ready to use condition. These aspects of the utility of the conventional handgun holster are extended to the occupant of a bed by the inventive device.

Whereas known devices in the prior art are directed at mounting handkerchiefs, bottles, cleaning tissue boxes, and the like adjacent to a bed, the inventive device relates more specifically to mounting a handgun holster. Further, the prior art is concerned with mounting items adjacent to a bed for the convenience rather than for the security of the occupant thereof, and so the prior art devices do not provide for the requisite rapid and reliable acquisition of an item, such as a handgun, held adjacent to a bed for use in an emergency situation.

SUMMARY OF THE INVENTION

The handgun holster mounting device consists of a pair of brackets positioned on opposite sides or apposite ends of a mattress and interconnected by a strap or the like which is disposed between the mattress and box spring or other mattress support. At least one of the opposing brackets is fitted with a holster support bar which is vertically adjustable utilizing a plurality of apertures in the bracket and conventional means of attachment such as bolts and nuts or other fasteners. The holster support bar fits through the belt loop of a belt type holster or within the clip of a clip-on holster which is held in position adjacent to the mattress.

The primary object of this invention is to provide a device whereby a handgun holster can be firmly secured in a particular selected position on a bed, adjacent to a mattress and box spring or other mattress support so that a handgun may be reliably located, easily reached, consistently grasped, readily withdrawn from the holster, and thereby secured by the occupant of the bed.

A further object of this invention is to provide a handgun holster mounting device which will allow a holstered handgun to be readily attached or removed from the device so that the holstered handgun may be worn or stored in another location when the bed is unoccupied.

A further object of this invention is to provide a handgun holster mounting device which will accommodate a variety of handgun holster sizes and configurations and will accommodate either right-handed or left-handed holsters.

A further object of this invention is to provide a handgun holster mounting device which may be readily used in conjunction with mattresses and box springs or other mattress supports of various sizes and configurations and may be readily removed and transferred between beds or may be otherwise readily removed and repositioned. It is therefore a further object of this invention to provide a handgun holster mounting device which does not require permanent or semi-permanent attachment to any bed frame structural member, but is sufficiently rigid to retain a handgun holster in place when the handgun resting therein is rapidly or forcefully withdrawn.

Still another object of this invention is to provide a handgun holster mounting device which optionally provides for mounting a second holster in accordance with the immediately preceding objects so that by means of a single holster mounting device, two holsters may be mounted on opposing ends or opposing sides of a bed.

Still another object of this invention is to provide a handgun holster mounting device in accordance with the preceding objects which will conform to conventional methods of manufacture and will be of simple construction utilizing common durable materials so as to provide a device that will be economically feasible, durable, and trouble-free in operation.

These and other objects, advantages, and features of this invention will become apparent to those skilled in the art from a consideration of the following written description in association with the accompanying drawings.

DESCRIPTION OF THE PREFERRED EMBODIMENT

Figure 1:
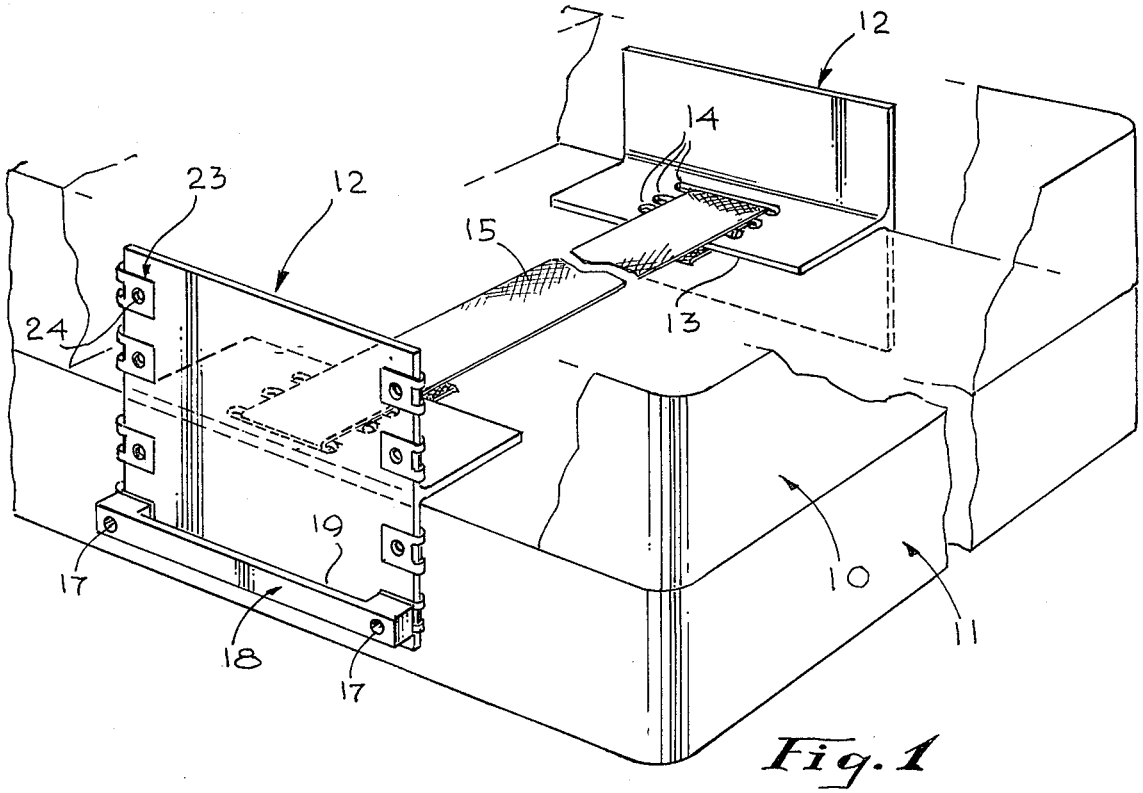
FIG. 1 is a perspective view of the invention shown installed on a bed.

Referring to FIG. 1, a mattress 10 is shown cut away to illustrate the invention which is shown installed between the mattress and the supporting box spring or other mattress support 11. T-shaped brackets 12 are held on opposite sides of the bed by a flexible connecting member 15 which is threaded through slots 14 in the base portion 13 of each of the opposing T-shaped brackets 12. The opposing T-shaped brackets are preferably formed of material which is non-corrosive and of suitable stiffness and economy of manufacture, such as aluminum or relatively rigid molded plastic. The flexible connecting member 15 preferably consists of a fabric strap or belt made from a durable material such as nylon webbing.

Figure 2:
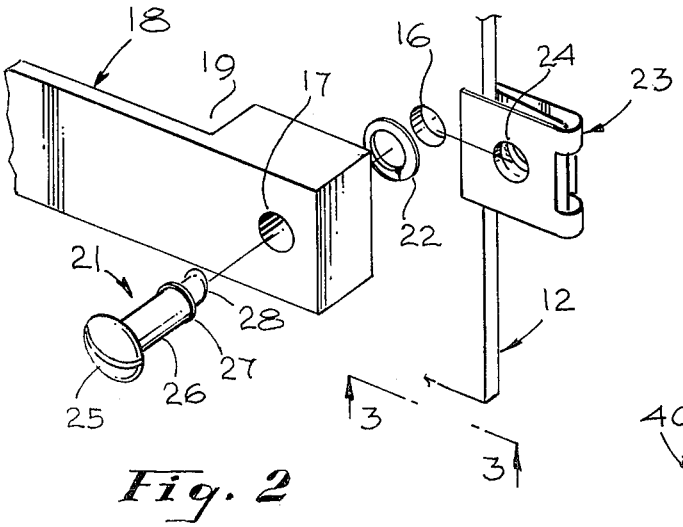
FIG. 2 is a fragmentary exploded view of the preferred means of attachment of the holster support bar to the T-shaped bracket.

Now referring to FIGS. 1 and 2, at least one of the T-shaped brackets has a plurality of holes 16 to permit attachment of a vertically adjustable holster support bar 18. The holster support bar 18, as illustrated, is preferably an elongated bar of rectangular cross-section with greater width at both ends than in the center portion thereof so that a recess 19, exists between the center portion of the holster support bar 18 and the T-shaped bracket 12 when the holster support bar is attached thereto. As an alternative construction, which is not illustrated, the holster support bar may be of constant cross-section, preferably rectangular, throughout its length and may be fitted at both ends with washers, shims, or spacers to establish a recess between the center of the holster support bar and the T-shaped bracket. The holster support bar 18 has holes 17 at both ends to permit attachment to the T-shaped bracket 12. The holster support bar is preferably formed of material having the same properties as that of the T-shaped bracket.

In FIG. 2 which illustrates attachment means which are identical for both ends of the holster support bar 18, a fastener stud 21 fits through a hole 17 in the holster support bar, near the end thereof, and is secured thereon by a split-ring retainer 22. A clip-on receptacle 23, having a hole 24 therein is fitted over the edge of the T-shaped bracket 12 and is oriented thereon so that the hole 24 in the clip-on receptacle is aligned with the hole 16 in the T-shaped bracket. The fastener stud 21 is preferably a bolt-like cylinder with a slotted head 25 and shaft 26, the head 25 being slotted so that a coin or screwdriver may be used to turn the fastener stud. The shaft 26 of the fastener stud 21 is fitted through the hole 17 in the holster support bar, the shaft having a raised portion 27 thereon so that the split ring retainer 22, affixed around the shaft 26 and between the holster support bar 18 and the raised portion 27 of the shaft, keeps the fastener stud 21 in the hole 17 when the holster support bar is detached from the T-shaped bracket 12. The fastener stud shaft 26 additionally has an angular planar portion 28 which by turning the fastener stud 21 is tightened in screw-like fashion to the clip-on receptacle 23. By turning the fastener studs 21 at both ends of the holster support bar 18, the holster support bar may be attached to or detached from the T-shaped bracket 12.

Figure 3:
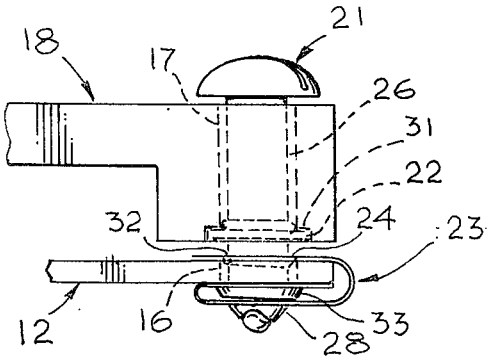
FIG. 3 is a partial bottom view of FIG. 2 further illustrating the preferred means of attachment of the holster support bar to the T-shaped bracket.

In FIG. 3, the fastener stud 21 is shown extending through the hole 17 in the holster support bar 18 as well as through the holes 16 and 24 in the T-shaped bracket 12 and the clip-on receptacle 23, respectively. The split-ring retainer 22 is shown fixed around the shaft 26 of the fastener stud preferably abutting a shoulder 31 in the hole 17 through the holster support bar so as to maintain the fastener stud in its position with respect to the holster support bar when the holster support bar is detached from the T-shaped bracket. The clip-on receptacle 23 is preferably formed from spring steel having a protrusion 32 on at least one surface which serves to align the holes 16 and 24 in the T-shaped bracket 12 and the clip-on receptacle 23. The clip-on receptacle also has an angular planar surface 33 which mates with the angular planar portion 28 of the shaft 26 of the fastener stud 21. A more detailed description of the clip-on receptacle is provided by U.S. Pat. No. 3,123,880. The fastener stud 21, split-ring retainer 22, and clip-on receptacle 23 are preferably selected from commonly available fasteners for reliability of operation and economy of manufacture. A fastener stud and retainer are fitted at each end of the holster support bar 18 and as illustrated in FIG. 1, a plurality of clip-on retainers are fitted in vertical columns at the respective ends of the T-shaped bracket to allow the holster support bar to be attached at the height desired by the user. As an alternative non-preferred construction which is not illustrated, common bolts and nuts may be used to attach the holster support bar to the T-shaped bracket.

Figure 4:
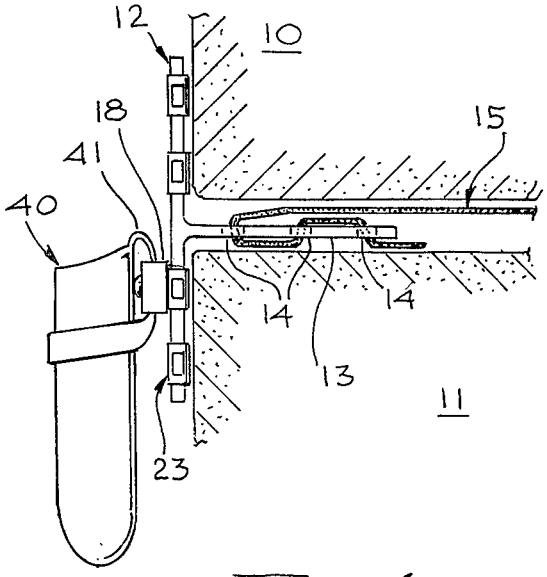
FIG. 4 is a fragmentary vertical cross-section through a bed having the invention applied thereto.

In FIG. 4, the flexible connecting member 15 is shown threaded through slots 14 in the base portion 13 of the T-shaped bracket 12 in the preferred manner whereby the flexible connecting member 15 is threaded through multiple slots 14 in order to prevent the flexible connecting member from slipping in relation to the T-shaped bracket. The flexible connecting member 15 threaded, as illustrated, through multiple slots 14 in each of the opposing T-shaped brackets 12 provides a secure anchor so that the T-shaped bracket 12 with handgun holster 40 attached remains fixed in its orientation when a handgun is rapidly or forcefully withdrawn from the handgun holster. The preferred holster configuration used in conjunction with the invention has a belt loop 41, as illustrated in FIG. 4, or a clip, which is not illustrated, which is securely held by the holster support bar 18 which extends through the belt loop or clip.

The invention may be embodied in other specific forms without departing from the purpose or essential characteristics thereof. The illustrated configuration is therefore to be considered as representative in all respects, but not restrictive, the scope of the invention being indicated by the following claims rather than by the foregoing description. All variations which come within the scope of the claims are, therefore, intended to be encompassed by the claims.

I claim:

1. A handgun holster mounting device for retaining a handgun holster in position adjacent to a mattress and mattress support, said holster mounting device comprising:

a pair of brackets positioned on opposite vertical surfaces of a mattress, at least one of said brackets being adapted for attachment of an elongated member thereto;

flexible means interconnecting said brackets, said flexible means disposed between the mattress and mattress support and serving to keep said brackets in position opposing each other;

an elongated member affixed to at least one of said brackets, said elongated member being vertically adjustable with respect to the bracket to which said elongated member is affixed, and said elongated member serving as the supporting and retaining means for a handgun holster; and attachment means for affixing said elongated member to said at least one of said brackets, said attachment means providing for easy disassembly and reassembly.

2. A handgun holster mounting device for retaining a handgun holster in position adjacent to a mattress and mattress support, said holster mounting device comprising:

a pair of brackets positioned on opposite vertical surfaces of a mattress, at least one of said brackets being adapted for attachment of an elongated member thereto;

flexible means interconnecting said brackets, said flexible means disposed between the mattress and mattress support and serving to keep said brackets in position opposing each other;

an elongated member affixed to at least one of said brackets; said elongated member comprising a bar of rectangular cross-section with greater width at both ends than in the center thereof so that a recess exists between the center portion of said bar and the bracket to which said bar is affixed, and said elongated member serving as the supporting and retaining means for a handgun holster; and attachment means for affixing said elongated member to said at least one of said brackets, said attachment means providing for easy disassembly and reassembly.

3. A handgun holster mounting device for retaining a handgun holster in position adjacent to a mattress and mattress support, said holster mounting device comprising:

a pair of brackets positioned on opposite vertical surfaces of a mattress, at least one of said brackets being adapted for attachment of an elongated member thereto;

flexible means interconnecting said bracket, said flexible means disposed between the mattress and mattress support and serving to keep said brackets in position opposing each other;

an elongated member affixed to at least one of said brackets, said elongated member comprising a bar of constant cross-section fitted with shims at both ends so that a recess exists between the center portion of said bar and the bracket to which said bar is affixed, and said elongated member serving as the supporting and retaining means for a handgun holster; and attachment means for affixing said elongated member to said at least one of said brackets, said attachment means providing for easy disassembly and reassembly.

* * * * *